US007758113B2

(12) United States Patent
Hanusiak et al.

(10) Patent No.: US 7,758,113 B2
(45) Date of Patent: Jul. 20, 2010

(54) STOOL WITH A NONCIRCULAR SUPPORT

(76) Inventors: Gregory Hanusiak, 7448 N. Osceola Ave., Chicago, IL (US) 60631; Jeremias C. Rivera, Jr., 668 Mary Ct., Elmhurst, IL (US) 60126; Doss Samikkannu, 950 Carlow Dr., Des Plaines, IL (US) 60016

( * ) Notice: Subject to any disclaimer, the term of this patent is extended or adjusted under 35 U.S.C. 154(b) by 0 days.

(21) Appl. No.: 12/231,166

(22) Filed: Aug. 29, 2008

(65) Prior Publication Data

US 2010/0052398 A1 Mar. 4, 2010

(51) Int. Cl.

| | |
|---|---|
| ***A47B 83/02*** | (2006.01) |
| ***A47B 3/00*** | (2006.01) |
| ***A47B 3/14*** | (2006.01) |
| ***A47C 9/00*** | (2006.01) |

(52) U.S. Cl. ..... 297/159.1; 297/134; 297/157.1; 297/158.4; 297/440.22; 297/461

(58) Field of Classification Search ..... 297/134, 297/135, 156, 157.1, 159.1, 440.22, 461, 297/158.4

See application file for complete search history.

(56) References Cited

U.S. PATENT DOCUMENTS

| | | | | | |
|---|---|---|---|---|---|
| D194,038 | S | * | 11/1962 | Preston | D6/337 |
| 3,075,809 | A | * | 1/1963 | Wilson | 297/158.4 |
| 3,109,678 | A | * | 11/1963 | Wilson | 297/158.4 |
| 3,230,909 | A | * | 1/1966 | Watson | 297/461 X |
| 3,230,910 | A | * | 1/1966 | Olsson | 297/461 |
| D211,886 | S | * | 8/1968 | Benjamin | D6/337 |
| 3,511,532 | A | * | 5/1970 | Tringali et al. | 297/158.4 |
| 3,715,143 | A | * | 2/1973 | Gerken et al. | 297/158.4 |
| 3,770,319 | A | * | 11/1973 | Ono | 297/461 |
| 4,208,072 | A | * | 6/1980 | Iskendarian | 297/440.22 X |
| D266,037 | S | * | 9/1982 | Heighberger | D6/349 |
| 4,921,303 | A | | 5/1990 | White | |
| 4,997,232 | A | | 3/1991 | Johnsen | |
| 4,998,774 | A | * | 3/1991 | Huff et al. | 297/461 |
| 5,112,103 | A | * | 5/1992 | Downer | 297/461 X |
| 5,236,170 | A | | 8/1993 | Johnsen | |
| 5,439,269 | A | * | 8/1995 | Cheng | 297/440.22 X |
| D413,734 | S | * | 9/1999 | Bue | D6/337 |
| 6,065,802 | A | * | 5/2000 | Bue | 297/159.1 X |
| 6,074,005 | A | | 6/2000 | Simmons | |
| 6,186,591 | B1 | * | 2/2001 | Pajerski | 297/159.1 |
| D439,060 | S | * | 3/2001 | Larsen | D6/337 |
| 6,254,178 | B1 | * | 7/2001 | Bue | 297/159.1 |
| D456,155 | S | * | 4/2002 | DeVriendt | D6/337 |
| 6,386,628 | B2 | * | 5/2002 | Bue | 297/159.1 X |
| D478,732 | S | * | 8/2003 | Pajerski et al. | D6/337 |
| D479,406 | S | * | 9/2003 | Pajerski et al. | D6/337 |
| D479,773 | S | * | 9/2003 | Pajerski et al. | D6/337 |
| 6,749,265 | B1 | * | 6/2004 | Wang | 297/440.22 X |
| 7,234,780 | B2 | * | 6/2007 | Lipniarski | 297/461 |
| 7,393,049 | B2 | * | 7/2008 | Chase | 297/134 |
| D595,969 | S | * | 7/2009 | Hanusiak et al. | D6/349 |

* cited by examiner

*Primary Examiner*—Rodney B White
(74) *Attorney, Agent, or Firm*—Ryndak & Suri LLP

(57) ABSTRACT

An improved seating apparatus is provided, including a seat supported by a fixed seat post, the seat post mating with a support mount fixed to the bottom of the seat. The aligned surfaces of the seat post and support mount are of a non-circular cylindrical shape to prevent rotation of the support mount with respect to the seat post.

7 Claims, 5 Drawing Sheets

STOOL WITH A NONCIRCULAR SUPPORT

FIELD OF THE INVENTION

The present invention relates to seating apparatus. More particularly, it relates to a seat supported by a fixed seat post, the seat post mating with a support mount fixed to the bottom of the seat.

BACKGROUND OF THE INVENTION

Typically, a stool seat may be supported by a single seat post attached to the center of the bottom of the seat and fixed to the ground, the floor of a building, or some other relatively stable or massive object. In particular, an institutional cafeteria-style table may include stool seating supported by vertical seat posts connected to a table frame. In one known arrangement, the seat post is inserted into a support mount and secured to the support mount by a bolt passing transversely through the support mount and seat post.

However, it has been discovered that stool occupants, frequently school children, may damage or even completely shear off the bolt by repeatedly twisting the seat back and forth. Apart from creating repair or replacement costs, this can result in a dangerous condition in which the seat of the stool is free to spin on the seat post, possibly even encouraging stool occupants to risk injury by using the stool for recreation. For example, when the seat is made of plastic and the seat post is metallic, spinning on the seat may cause the seat post to wear through the seat, and the occupant may be injured, either by falling or by impalement on the seat post itself.

A need therefore exists for more durable and safer seating for attachment to cafeteria tables and the like.

BRIEF SUMMARY OF THE INVENTION

In accordance with one aspect of the present invention, a seating apparatus is provided, including a seat; a support mount fixed with respect to the seat, an at least substantially vertical extent of the support mount having a noncircular cylindrical surface; and a seat post mating with the support mount, an at least substantially vertical extent of the seat post having a noncircular cylindrical surface. The noncircular cylindrical surface of the seat post aligns with the noncircular cylindrical surface of the support mount to substantially prevent rotational movement of the seat with respect to the seat post.

In one embodiment of the present invention, the noncircular cylindrical surface of the seat post is an exterior surface of the seat post, the noncircular cylindrical surface of the support mount is an interior surface of the support mount, and the extent of the seat post is at least partially inserted into the extent of the support mount.

In another embodiment of the present invention, the seating apparatus is a stool, the seat is composed at least substantially of plastic, and the seat post is composed at least substantially of metal.

In another embodiment of the present invention, the aligned non-circular cylindrical surfaces have polygonal horizontal cross sections. Advantageously, the polygonal horizontal cross sections may be at least substantially square.

In another embodiment of the present invention, wherein the noncircular cylindrical surfaces of the seat post and support mount include aligned bolt holes, and a bolt extends through the aligned bolt holes to attach the support mount to the seat post.

In another embodiment of the present invention, the seat post is attached to a table.

In another embodiment of the present invention, the seat post is attached to the ground.

In another embodiment of the present invention, the seat post is attached to an immovable structure.

DETAILED DESCRIPTION OF THE INVENTION

A durable and safe seating apparatus having a seat supported by a single seat post is described in this section.

Figure 1:
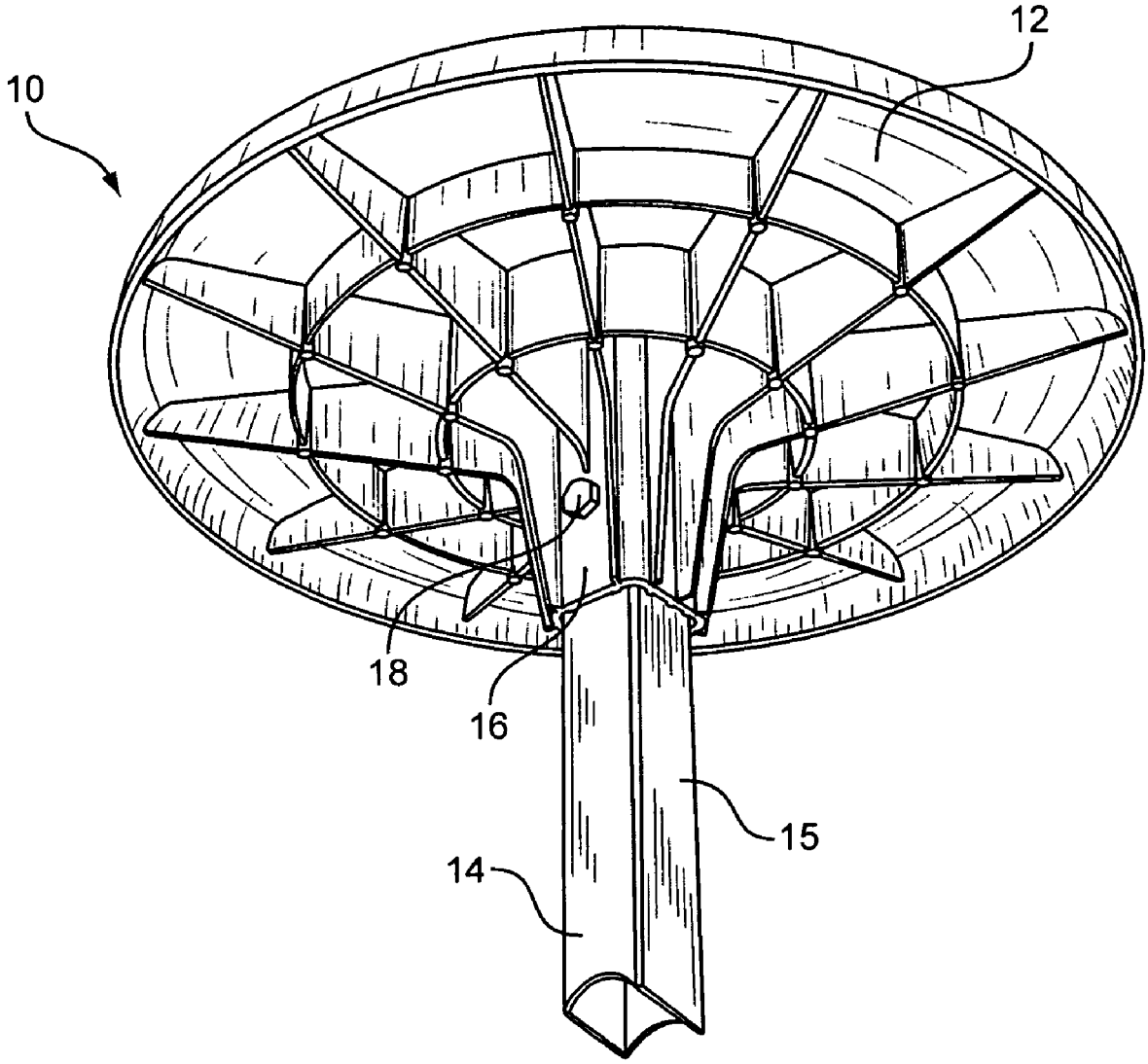
FIG. 1 is a perspective view of a seating apparatus in accordance with the present invention.
Figure 2:
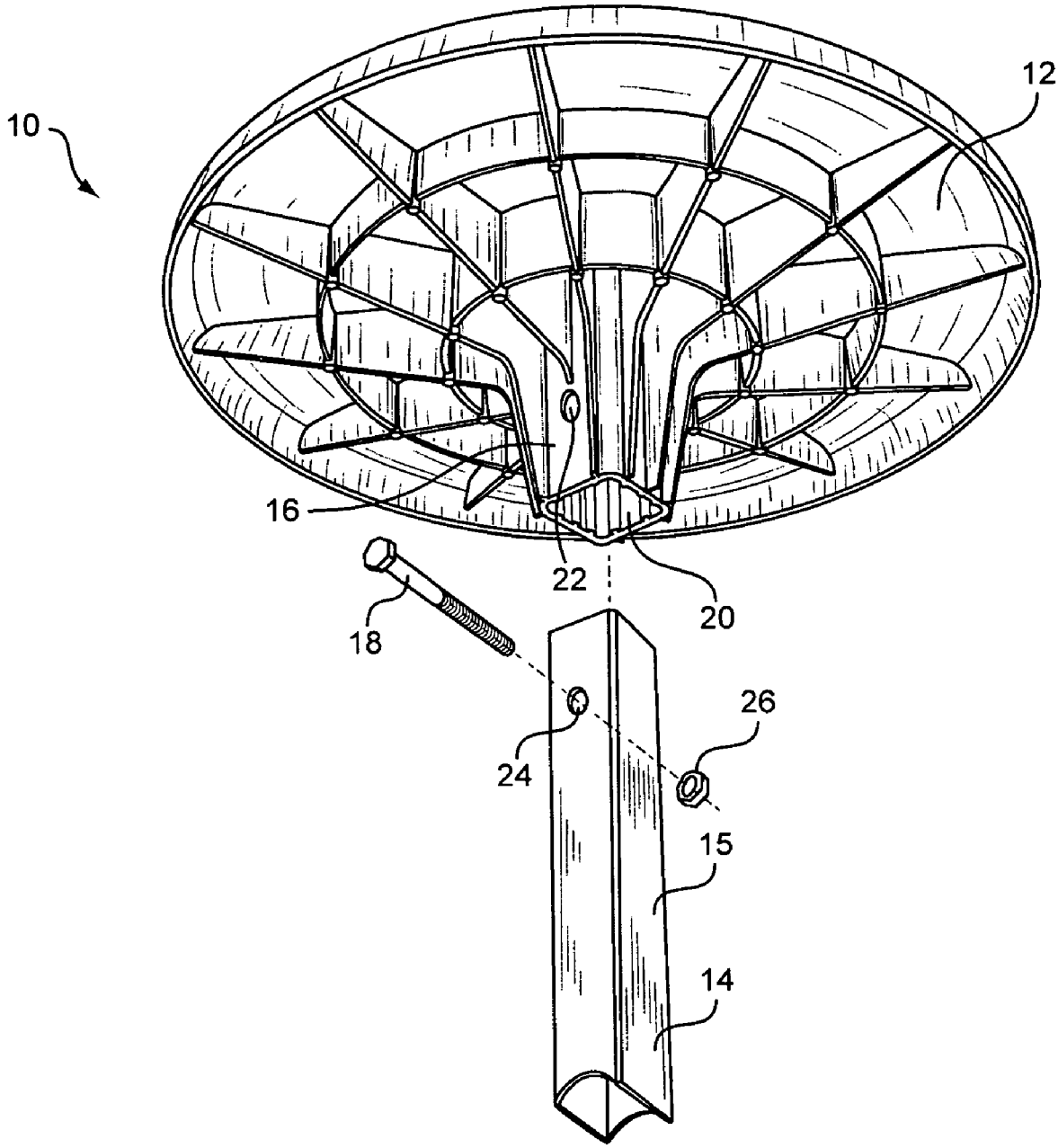
FIG. 2 is an exploded perspective view of a seating apparatus in accordance with the present invention.

Referring to FIGS. 1 and 2, there is shown a seating apparatus 10 in accordance with the present invention. As shown in FIG. 1, seating apparatus 10 includes a stool seat 12 and a seat post 14 having a substantially square cylindrical exterior surface 15. Seat post 14 is inserted into a support mount 16 and secured to support mount 16 by a bolt 18. Support mount 16 is shown in FIGS. 1 and 2 as integral with stool seat 12, but a separate support mount that is bolted or otherwise securely fastened to stool seat 12 is also within the scope of the present invention. FIG. 2 is an exploded view in which the assembly of seating apparatus 10 is illustrated. As shown, seat post 14 is adapted to be inserted into support mount 16 so that its exterior surface 15 aligns with a substantially square interior surface 20 of support mount 16, and a bolt hole 22 of support mount 16 aligns with a bolt hole 24 of seat post 14. Bolt 18 is then passed through bolt holes 22 and 24 and corresponding bolt holes (not shown) on the opposite sides of support mount 16 and seat post 14, and secured with a nut 26.

Because of the alignment of substantially square cylindrical exterior surface 15 of seat post 14 with substantially square cylindrical interior surface 20 of support mount 16, as illustrated in FIGS. 1 and 2, stresses caused by a stool occupant attempting to twist while seated on seating apparatus 10 will be at least substantially borne by stool seat 12 and seat post 14 rather than by bolt 18. Therefore, it would be practically impossible for a stool occupant to shear off bolt 18 by twisting on stool seat 12, and moreover, even without bolt 18 it would be practically impossible to spin stool seat 12 around seat post 14. Thus, seating device 10 as illustrated in FIGS. 1 and 2 has vastly improved safety and durability over known seating devices wherein a circular seat post mates with a circular support mount, and twisting stresses are substantially borne by a bolt securing the support mount to the seat post.

Figure 3:
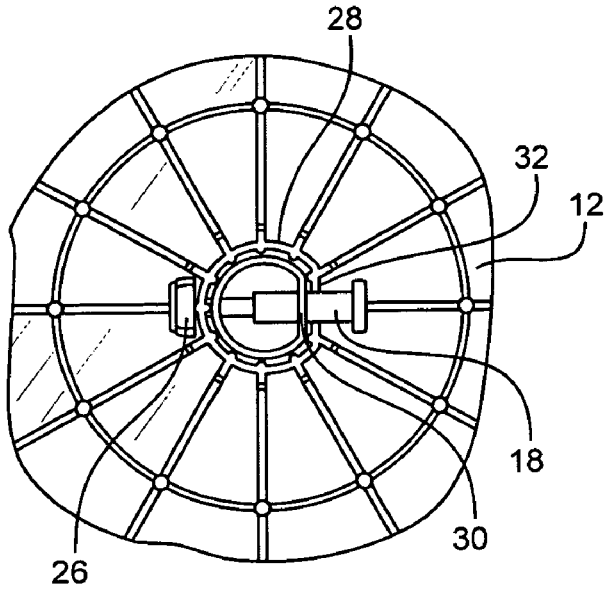
FIG. 3 is a bottom fragmentary elevation view illustrating an alternative shape for a seat post and support mount of a seating apparatus according to the present invention.
Figure 4:
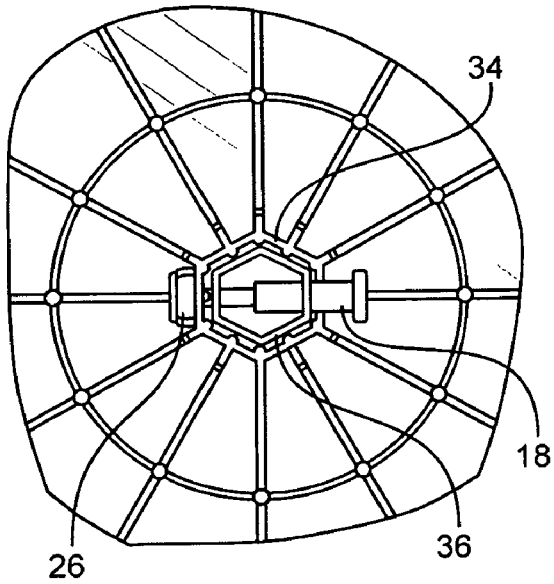
FIG. 4 is a bottom fragmentary elevation view illustrating an alternative shape for a seat post and support mount of a seating apparatus according to the present invention.
Figure 5:
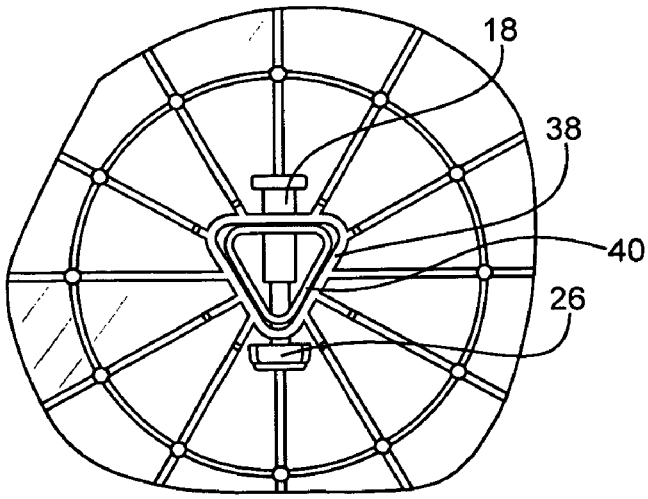
FIG. 5 is a bottom fragmentary elevation view illustrating an alternative shape for a seat post and support mount of a seating apparatus according to the present invention.

Turning to FIGS. 3-5, the aligned surfaces of a support mount and seat post may also have other noncircular cylindrical shapes within the scope of the present invention. In the example shown in FIG. 3, a support mount 28 and seat post 30 have aligned surfaces whose cross section is in the form of a circular arc joined at its ends by a flat edge 32. One advantage of this embodiment is that seat post 30 can only be inserted into support mount 28 in one orientation, thus avoiding confusion and facilitating proper assembly. Seating apparatus having a hexagonal support mount 34 and seat post 36 or a triangular support mount 38 and seat post 40, as depicted in FIGS. 4 and 5, respectively, are also within the scope of the present invention, as well as those having support mounts and seat posts of any other noncircular cylindrical shape.

Although seating apparatus described above with reference to the Figures have seat posts that insert into support mounts, it is also within the scope of the present invention for a support mount of a seat to insert into a seat post, provided that the aligned surfaces of the support mount and seat post have a noncircular cylindrical shape to prevent the seat from twisting relative to the seat post. It should also be noted that a suitable seat including an upright back support member could be substituted for stool seat 12.

Figure 6:
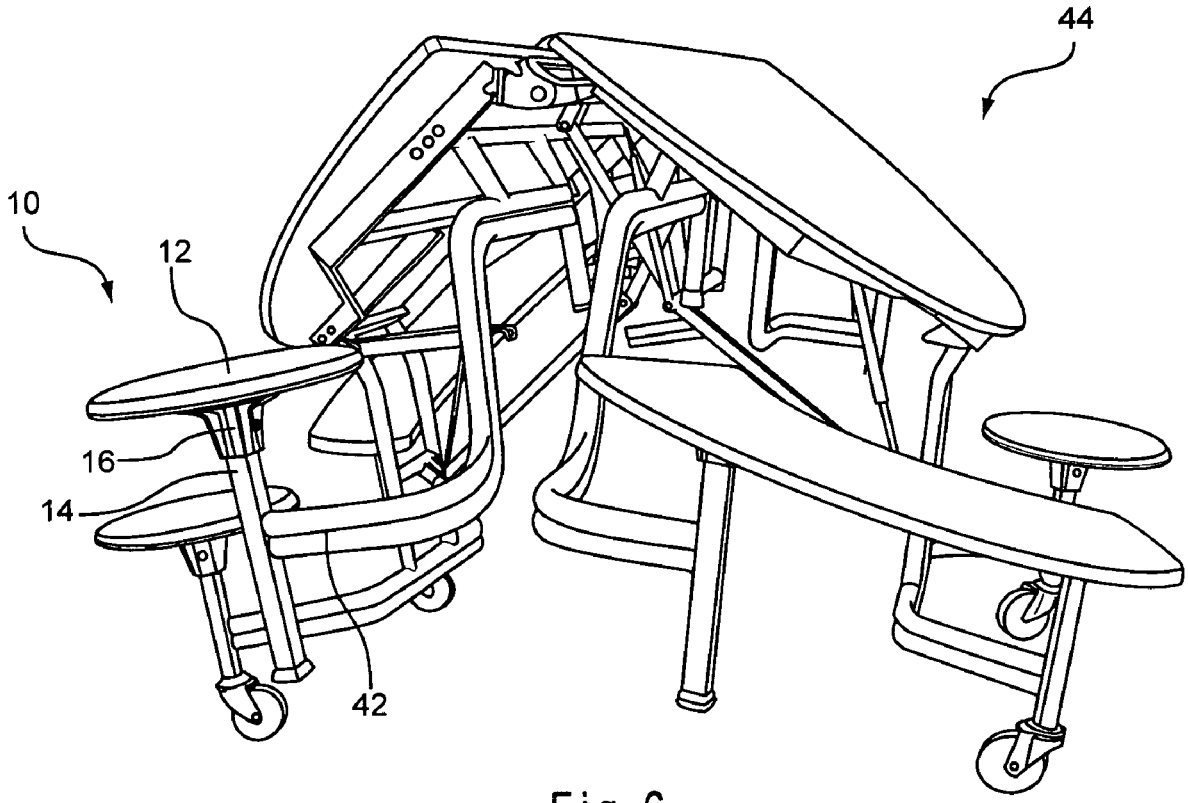
FIG. 6 is a perspective view of a table incorporating a seating apparatus in accordance with the present invention.

Seating apparatus 10 according to the present invention is advantageously used in public or institutional seating where safety and resistance to twisting are highly desirable. For example, turning to FIG. 6, seat post 14 may be integral with a frame 42 of an institutional folding table 44. Alternatively, although not shown in the Figures, seat post 14 may be securely attached to the floor of a building, as is typical of some bar stools, or in an outdoor setting, to the ground, as is typical of seating in public parks or public transportation stops.

Figure 7:
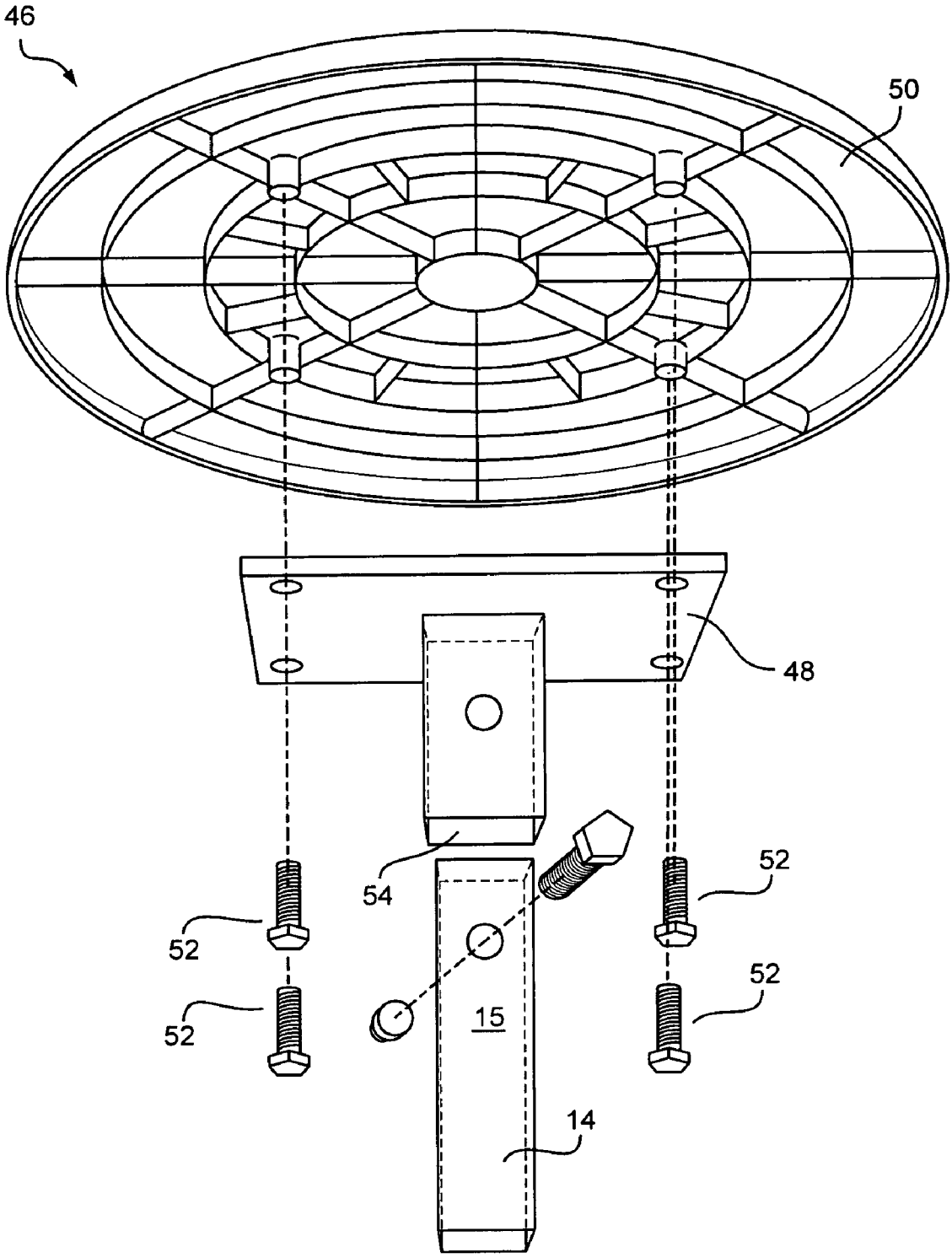
FIG. 7 is an exploded perspective view of an alternative seating apparatus in accordance with the present invention.

Another variation of a seating apparatus within the scope of the present invention is shown in exploded perspective view in FIG. 7. Seating apparatus 46 is substantially similar to seating apparatus 10, but instead of a support mount 16 integral with a seat 12, seating apparatus 46 incorporates a separate support mount 48 bolted to a seat 50 by bolts 52. Like support mount 16, support mount 48 has a square cylindrical interior surface 54 to align with square cylindrical exterior surface 15 of seat post 14.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A seating apparatus comprising a seat;

a support mount fixed with respect to the seat, an at least substantially vertical extent of the support mount having a noncircular cylindrical surface; and an elongate seat post having a substantially uniform cross section mating with the support mount, an at least substantially vertical extent of the seat post having a noncircular cylindrical surface;

wherein one of the noncircular cylindrical surfaces is at least partially inserted into the other noncircular cylindrical surface to substantially prevent rotational movement of the seat with respect to the seat post, and wherein the seat post is attached to a table.

2. A seating apparatus according to claim 1, wherein the noncircular cylindrical surface of the seat post is an exterior surface of the seat post;

the noncircular cylindrical surface of the support mount is an interior surface of the support mount; and the extent of the seat post is at least partially inserted into the extent of the support mount.

3. A seating apparatus according to claim 1, wherein the seating apparatus is a stool;

the seat is composed at least substantially of plastic; and the seat post is composed at least substantially of metal.

4. A seating apparatus according to claim 1, wherein the aligned non-circular cylindrical surfaces have polygonal horizontal cross sections.

5. A seating apparatus according to claim 4, wherein the polygonal horizontal cross sections are at least substantially square.

6. A seating apparatus according to claim 1, wherein the noncircular cylindrical surfaces of the seat post and support mount include aligned bolt holes, further comprising a bolt extending through the aligned bolt holes to attach the support mount to the seat post.

7. A seating apparatus according to claim 1, wherein the seat is supported substantially only by a single seat post mating with the support mount.

* * * * *